US005346102A

United States Patent [19]

Bhagwat

[11] Patent Number: 5,346,102

[45] Date of Patent: Sep. 13, 1994

[54] DISPENSING CARTRIDGE HAVING A RESILIENT FOLLOWER

[75] Inventor: Anil Bhagwat, Hemel Hempstead, England

[73] Assignee: Xerox Corporation, Stamford, Conn.

[21] Appl. No.: 82,863

[22] Filed: Jun. 28, 1993

[30] Foreign Application Priority Data

Jul. 17, 1992 [GB] United Kingdom ..... 9215262.8

[51] Int. Cl.[5] ..... B65D 37/00; B67D 5/42

[52] U.S. Cl. ..... 222/206; 222/326; 222/386.5; 222/DIG. 1

[58] Field of Search ..... 222/325, 326, 386.5, 222/105, 94, DIG. 1, 206, 215

[56] References Cited

U.S. PATENT DOCUMENTS

| | | | |
|---|---|---|---|
| 3,249,262 | 5/1966 | Barr et al. | 222/386.5 X |
| 3,847,309 | 11/1974 | Grossman | 222/386.5 |
| 4,760,937 | 8/1988 | Evezich | 222/386.5 X |
| 4,836,409 | 6/1989 | Lane | 222/386.5 X |
| 4,984,713 | 1/1991 | Chambers et al. | 222/386.5 X |
| 5,137,179 | 8/1992 | Stoffel | 222/386.5 X |
| 5,148,223 | 9/1992 | Cipolla | 222/DIG. 1 X |
| 5,153,659 | 10/1992 | Maiefski et al. | 222/DIG. 1 X |
| 5,280,324 | 1/1994 | Ono et al. | 222/DIG. 1 X |

*Primary Examiner*—Andres Kashnikow
*Assistant Examiner*—Kenneth DeRosa
*Attorney, Agent, or Firm*—John S. Wagley

[57] ABSTRACT

The invention relates to a dispensing cartridge adapted to discharge material to a receiving member during a dispensing operation. The dispensing cartridge comprises an outer member which defines a chamber and an outer port therein and an inner member. The inner member defines a chamber for storing the material and an inner port therein. The inner member is located within the chamber of the outer member with the inner port thereof being aligned with the outer port of the outer member during the dispensing operation. The inner member is adapted to change shape during the dispensing operation to facilitate the dispensing of material from the chamber of the inner member, through the inner and outer port, and to the receiving member.

10 Claims, 11 Drawing Sheets

DISPENSING CARTRIDGE HAVING A RESILIENT FOLLOWER

The present invention relates to a dispensing cartridge which is particularly, although not exclusively, useful as a toner dispensing cartridge for an electrophotographic copying machine. The cartridge is of the kind comprising a housing having an exit aperture for allowing material to be dispensed into a receiver during a dispensing operation.

During the operation of a typical electrophotographic copying machine, particulate toner material is consumed as each electrostatic latent image is developed with toner, and the developed image transferred to a copy sheet. Toner thus consumed is replenished, either by adding new toner to a toner hopper or reservoir which is built into the machine, or by exchanging an empty cartridge, which is in the form of a removable hopper, for a full one. The cartridge may equally easily be used either to load particulate material into a hopper, or to provide a hopper which remains in place on a machine until it is empty. The cartridges may have different shaped housings but commonly the exit aperture is of substantially oblong shape. One such cartridge has a tubular housing with an oblong exit aperture which, for transport purposes, is sealed after filling by an adhesive strip. One of the problems encountered with cartridges is that when the toner has been used up it is quite likely that some toner will be left behind. This will occur as a result of the circular shape of the inner tube as well as the small width of the slot for delivery of the toner into the dispense housing.

An object of the present invention is to provide a device which will facilitate the removal of toner from the cartridge to minimize the toner left behind in the cartridge.

Accordingly, the present invention provides a dispensing cartridge adapted to discharge material to a receiving member during a dispensing operation. The dispensing cartridge comprises an outer member which defines a chamber and an outer port therein and an inner member. The inner member defines a chamber for storing the material and an inner port therein. The inner member is located within the chamber of the outer member with the inner port thereof being aligned with the outer port of the outer member during the dispensing operation. The inner member is adapted to change shape during the dispensing operation to facilitate the dispensing of material from the chamber of the inner member, through the inner and outer port, and to the receiving member.

The present invention will be described further, by way of examples, with reference to the accompanying drawings in which:

FIGS. 1*a* and 1*b* show a cross-section through the inner tube of a cartridge housing incorporating a device in accordance with a first embodiment of the invention;

FIG. 1*c* shows a cross-section through the device of FIGS. 1*a* and 1*b;*

FIGS. 2*a* and 2*b* show a cross-section through the inner tube of a cartridge housing incorporating a device in accordance with a second embodiment of the invention;

FIG. 2*c* shows a cross-section through the device of FIGS. 2*a* and 2*b;*

FIGS. 3*a* and 3*b* show a cross-section through the inner tube of a cartridge housing incorporating a device in accordance with a third embodiment of the invention;

FIGS. 4*a* and 4*b* show a cross-section through the inner tube of a cartridge housing incorporating a device having the configuration of FIG. 3*a* but also including biassing means for providing elastic stored energy during deformation;

Figure 1A:
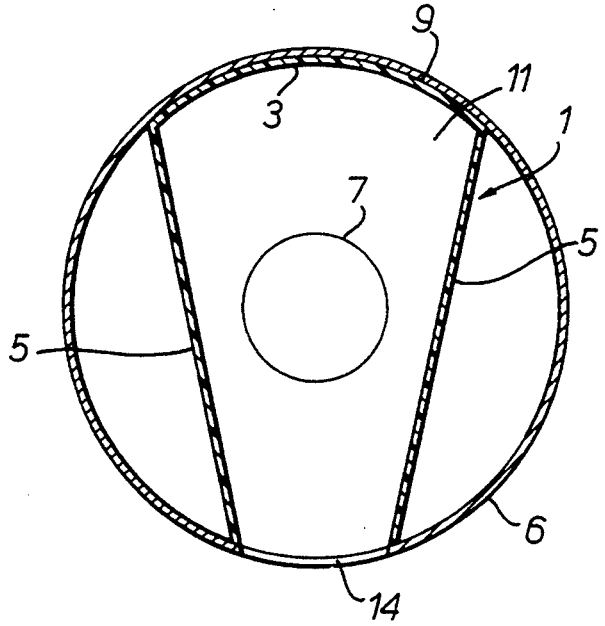
Figure 1C:
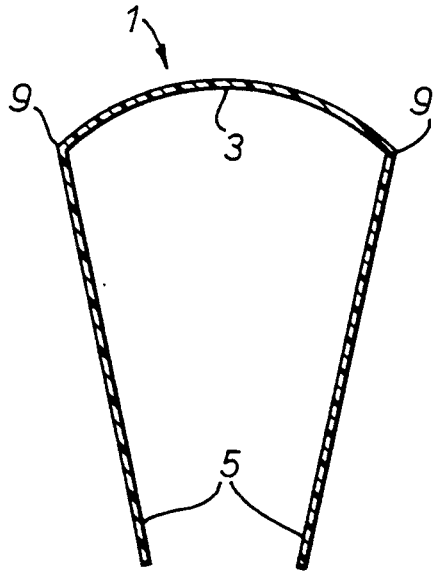
Figure 1B:
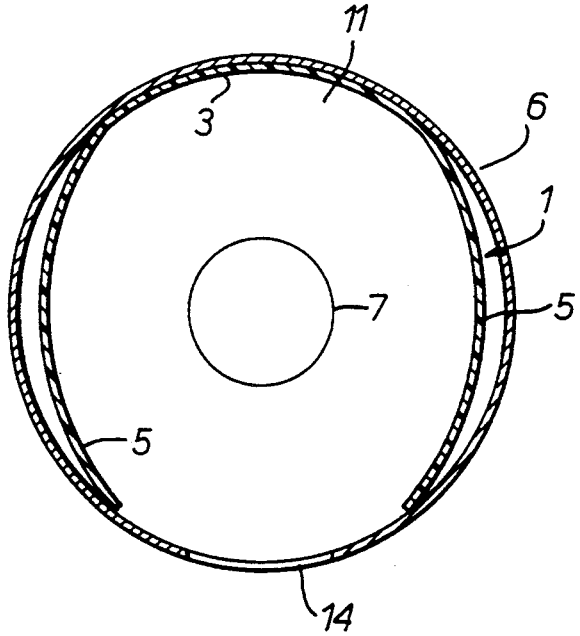

Referring to FIGS. 1*a* and 1*b* there is shown a cross-section through the inner tube 6 of a tubular cartridge housing incorporating a device 1 in accordance with a first embodiment of the invention. The device 1 is a resilient, elongate, plastics structure which extends along the length of the tube 6. The structure has a curved central portion 3 which, when installed, is fixed by a layer of glue 9 to the inside wall of the housing. The remainder of the integral structure defines two side flaps 5, one on each side of the curved portion 3. The flaps 5 are designed to bend and hug the inner surface of the housing (as illustrated in FIG. 1*b*) when the device is full of material, the material being poured into the cartridge through a central filling hole 7 located at one end of the housing; and are free to move and straighten out (as illustrated in FIG. 1*a*) as the material is dispensed from the cartridge through an oblong slot 14 into the receiver. In this way a chamber 11 for receiving the material first increases in volume during a filling operation and then reduces in volume during a dispensing operation. This action together with the movement of the elongate ends of the flaps 5 along the length of the inside wall towards alignment with the edges of the slot 14 during a dispensing operation facilitate the removal of the material from the chamber 11 minimizing the quantity of toner retained in the chamber 11. FIG. 1*c* shows the configuration of the device 1 when taken out of the housing, the flaps 5 being integral with the curved portion 3 and fold lines 19 maintaining the original configuration of the structure.

Figure 2A:
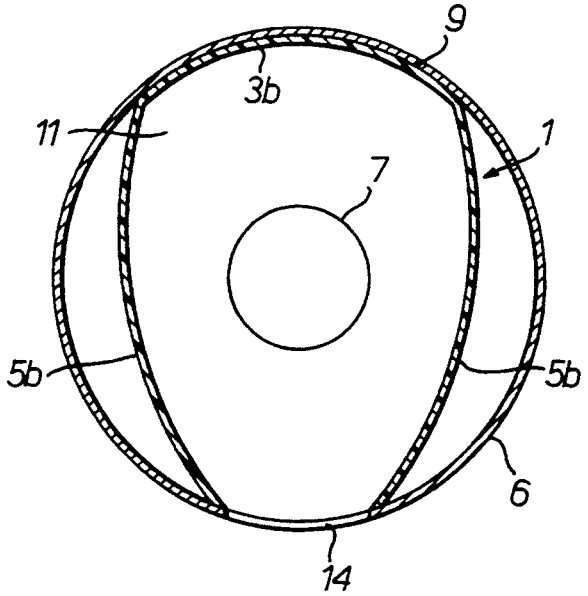
Figure 2C:
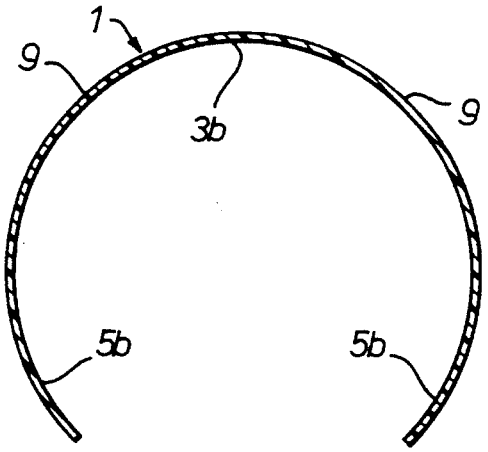
Figure 2B:
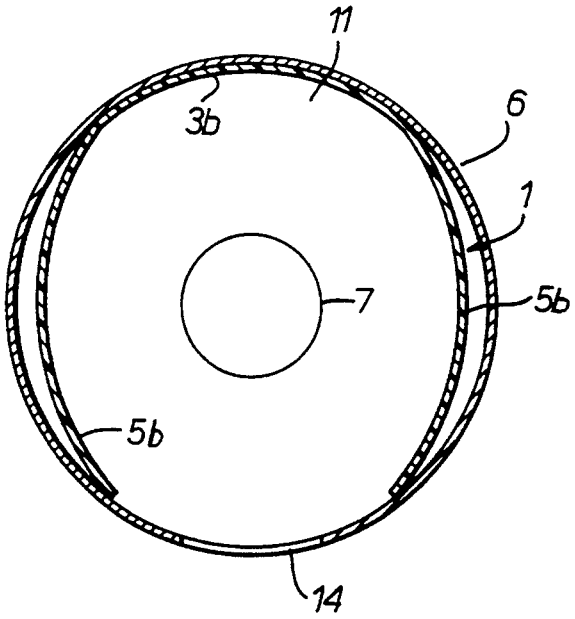

Another embodiment of the device is shown in FIGS. 2*a*, 2*b* and 2*c*, the device structure comprising an elongate strip of plastic of substantially U-shaped cross-section at least part of a curved portion 3*b* of which is fixed to the inside wall of the housing. A pair of integrally formed, curved flaps 5*b* of the structure, on each side of the curved portion 3b, are resilient and adapted to move automatically towards the inside wall of the housing during a filling operation of the cartridge and to move automatically away from the inside wall during a dispensing operation. As can be seen by comparing FIGS. 2a and 2c the flaps 5b are slightly deformed when inserted into the tube 6 as their longitudinal edges are constrained by the inner wall of the tube 6. The action of the device is similar to that of FIG. 1 in that the volume 11 defined within the structure increases during the filling operation and decreases during the dispensing operation, the edges of the flaps 5b slowly slipping along the inside wall of the tube 6 during the dispensing operation until they are in alignment with the edges of the slot 14. The sliding action of the ends of the flaps 5b forces out material that may have adhered to the wall of the tube 6 in the vicinity of the slot 14.

In both of the embodiments described above the fixing, by for example adhesive, of the dome-shaped portion 3 to the inside wall of the tube 6, although desirable, is not essential. The device 1 may, for example, be installed as a resilient insert into the tube 6 defining an elongate chamber for the material, the curved portion 3 being held under compression within the confines of the inside wall.

Figure 3A:
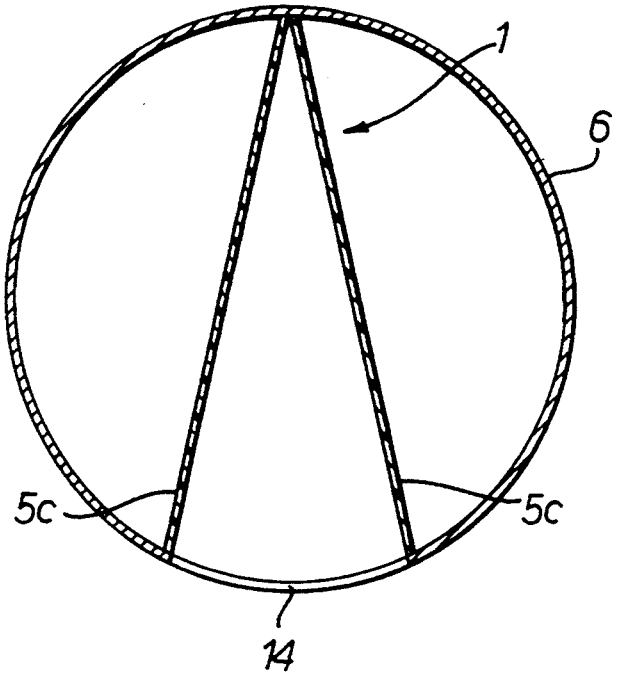
Figure 3B:
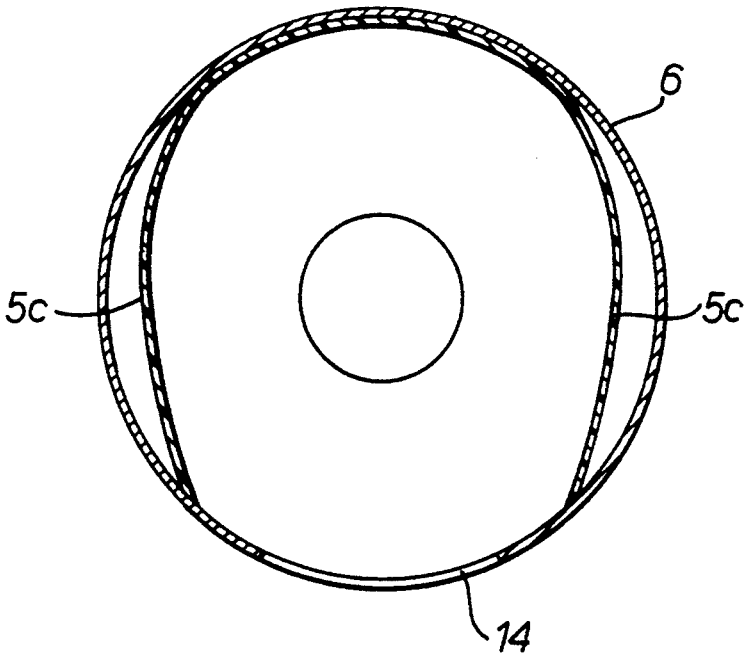
Figure 4A:
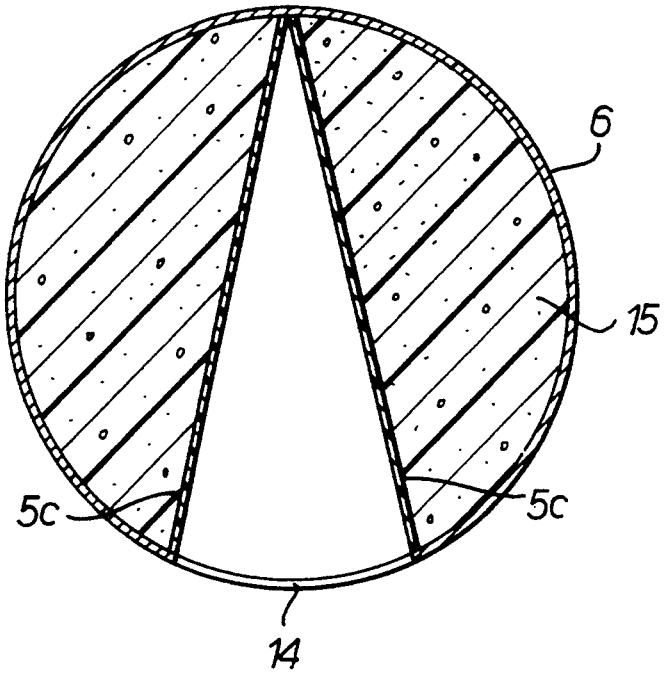
Figure 4B:
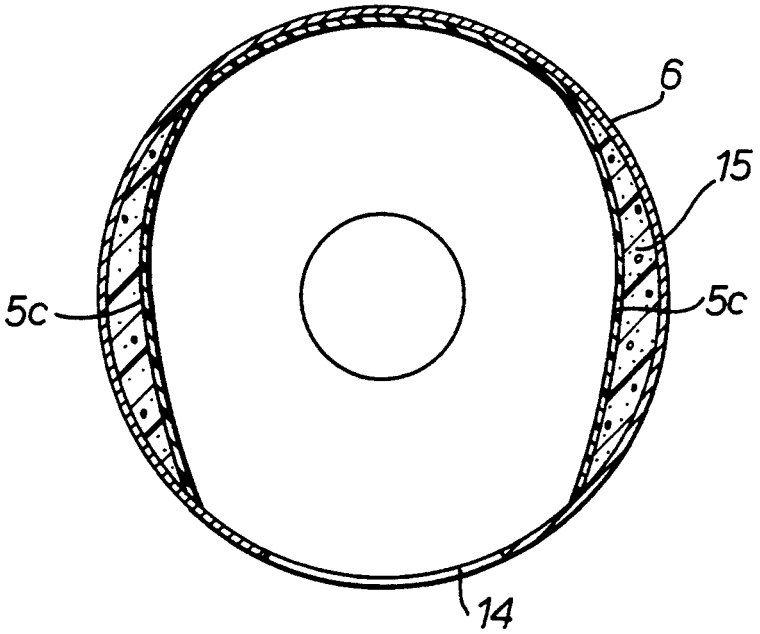

FIGS. 3a and 3b illustrate an arrangement in which the device is a resilient, elongate insert having, in this embodiment, a V-shaped cross-section, the insert being held in place within the confines of the inside wall of the tube 6. The device is inserted into the tube 6 in the configuration shown in FIG. 3a to define a chamber 11 of substantially triangular cross-section which expands, when filled, to a configuration shown in FIG. 3b. In an alternative embodiment shown in FIGS. 4a and 4b a biasing means, for example a foam material 15, can be located in the space between the insert I and the inside walls of the tube 6. The material 15 is compressed and stores elastic energy during the filling of chamber 11, the energy being released during the dispensing operation. As in the previous embodiments described the ends of the leg 5c of the insert move along the inside wall during a dispensing operation facilitating removal of toner from the housing.

It will be appreciated that many configurations of insert may be employed depending on the shape of the housing in which it is placed and the characteristics of the material used for the insert. Although the examples described above are for elongate inserts extending along the length of tubular cartridge housings it will be appreciated that the invention is applicable to other shaped cartridge housings. For example, the invention is applicable to cartridges having housings of the shape described in European patent No. 0225745, the contents of which are incorporated herewith by reference, or housings having a more spherical shape. For both tubular and non-tubular housings balloon or bladder shaped devices, similar to that described above in relation to FIG. 2, may be adopted. Such configurations are found to hug more closely the inside wall of the housing expanding, during the filling procedure, into recessed areas between wall formations thereby maximizing the available volume of the chamber 11.

Figure 5:
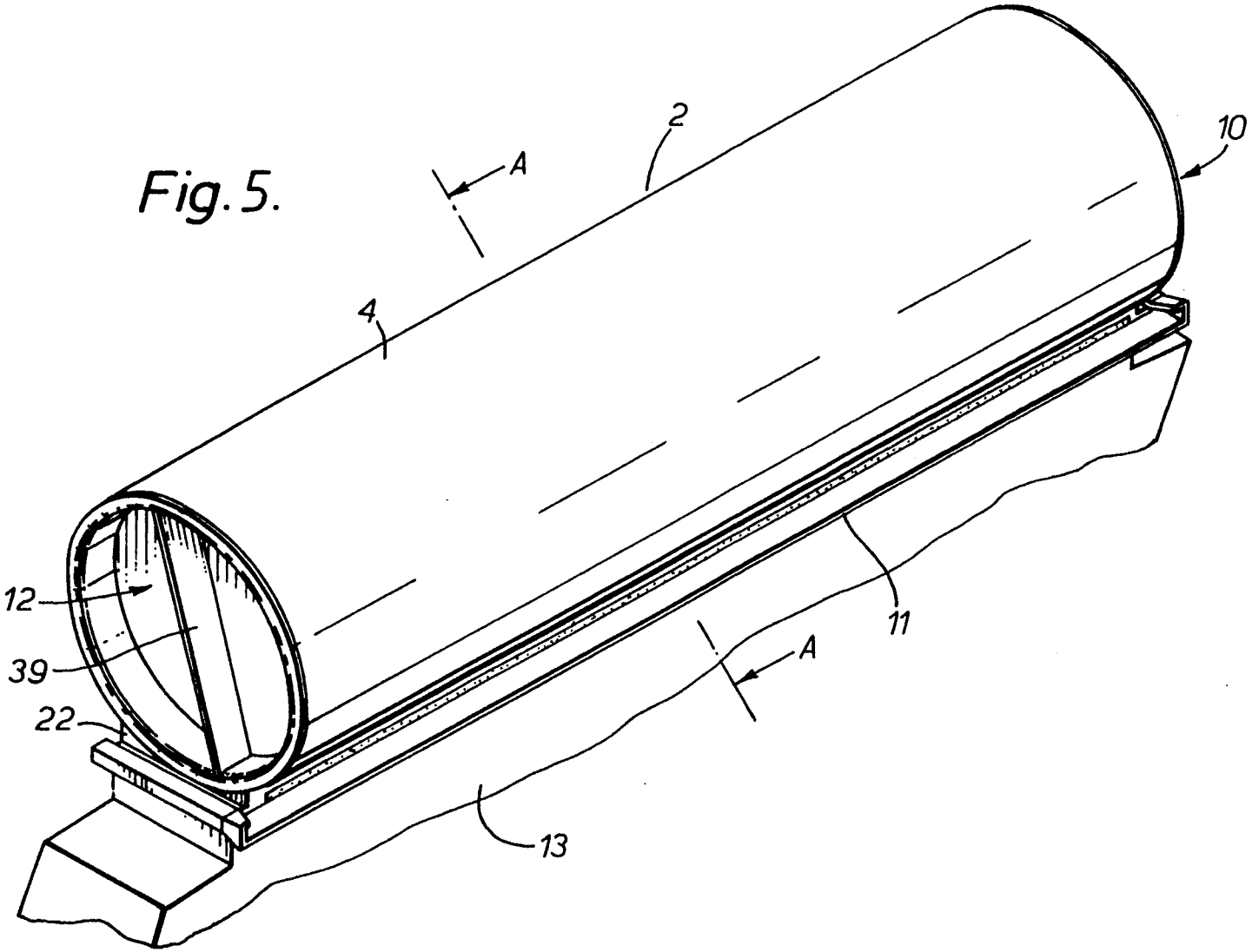
FIG. 5 is a perspective view of a cartridge in accordance with one embodiment of the invention mounted on a toner sump and incorporating the device of FIG. 1*c;*
Figure 6:
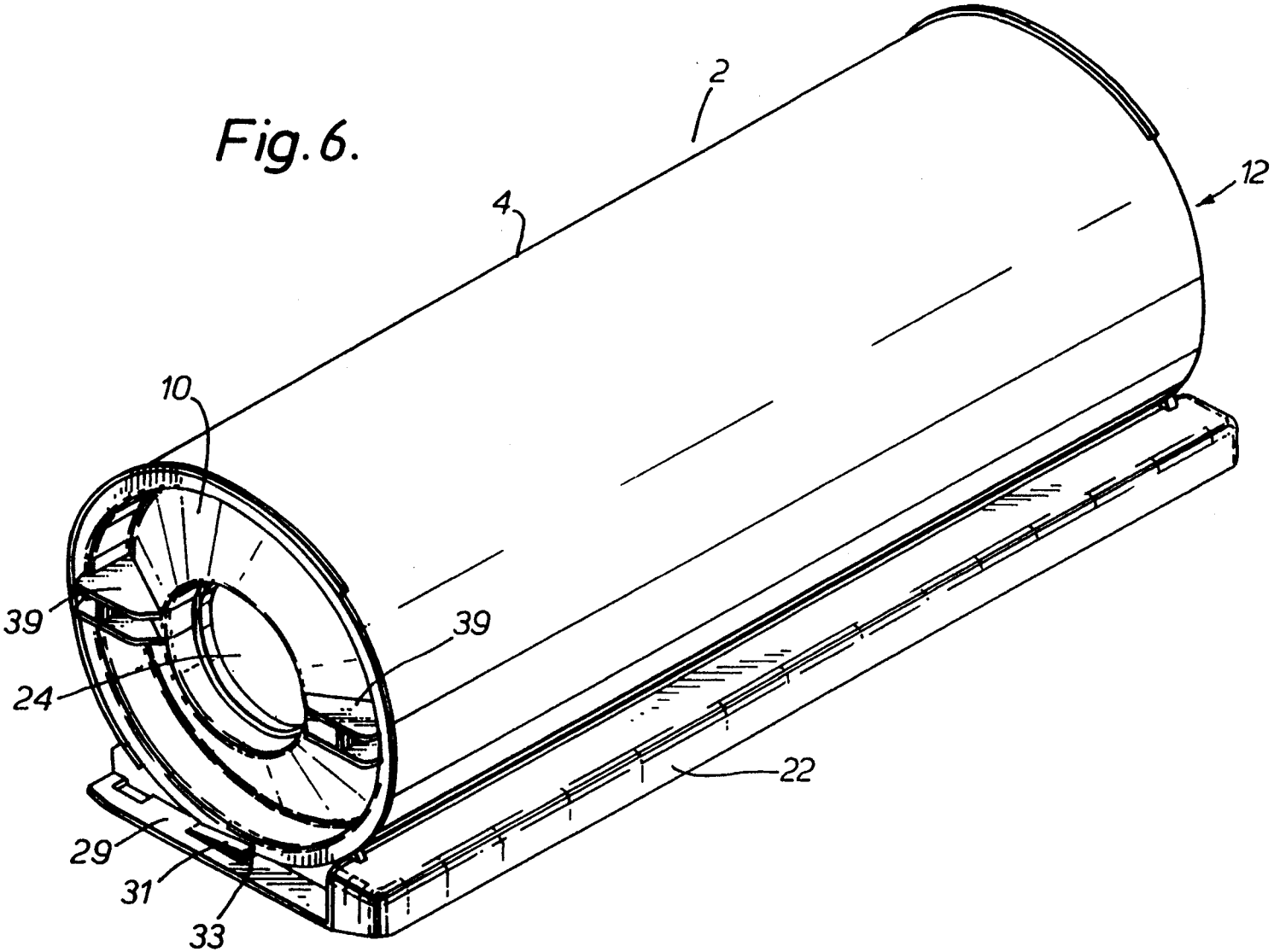
FIG. 6 is a perspective view from the opposite side of the cartridge of FIG. 6 but with the toner sump omitted so as to show the mounting flange of the cartridge in more detail.
Figure 7:
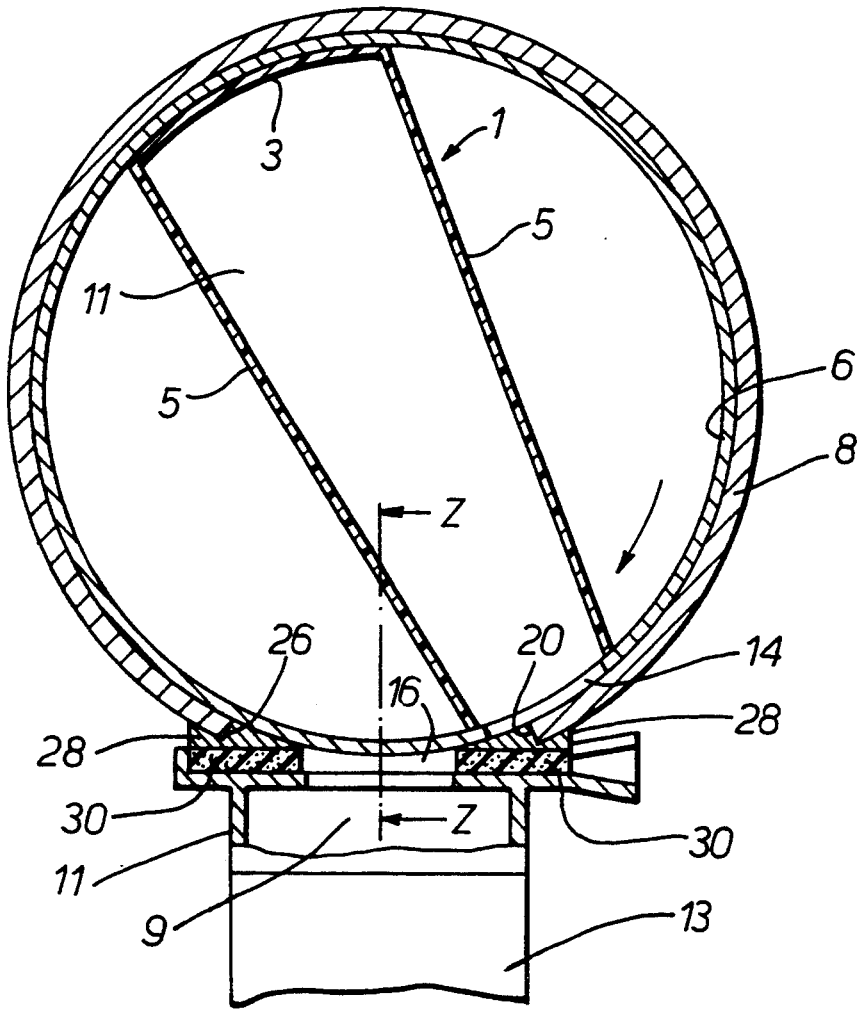
FIG. 7 is a cross-section through the cartridge along the line A—A of FIG. 5 showing the device incorporated therein.

Referring to FIGS. 5, 6 and 7 of the drawings, the cartridge 2 comprises a tubular housing 4 which is closed at its ends with two end caps 10, 12. The housing 4 comprises an inner plastic or cardboard tube 6 located concentrically within, and mounted for rotational movement relative to, an outer plastic or cardboard tube 8. The outer surface of the inner tube 6 is arranged for sliding contact with the inner surface of the outer tube 8. A sealing material lining is provided on one of the inner or outer surfaces, or on both of the surfaces, for inhibiting leakage of material from the inner tube 6 during transit of the cartridge. Each of the concentric tubes 6, 8 has a respective longitudinal port 14, 16, the arrangement being such that the pair of ports 14, 16 do not line up during transit. When as described below the ports 14, 16 of the tubes 6, 8 are aligned during a dispensing operation then they together define an exit aperture for the housing 4. The cartridge, after insertion into the machine, is mounted on a toner sump flange 1 I so that the exit aperture lines up with the inlet port 9 of the toner sump 13. As shown in FIG. 7 an elongate device 1, shaped from a thin resilient plastics material, extends along the length of the inner tube 6. In the configuration shown the device I indicates that the cartridge is empty of toner.

Figure 8:
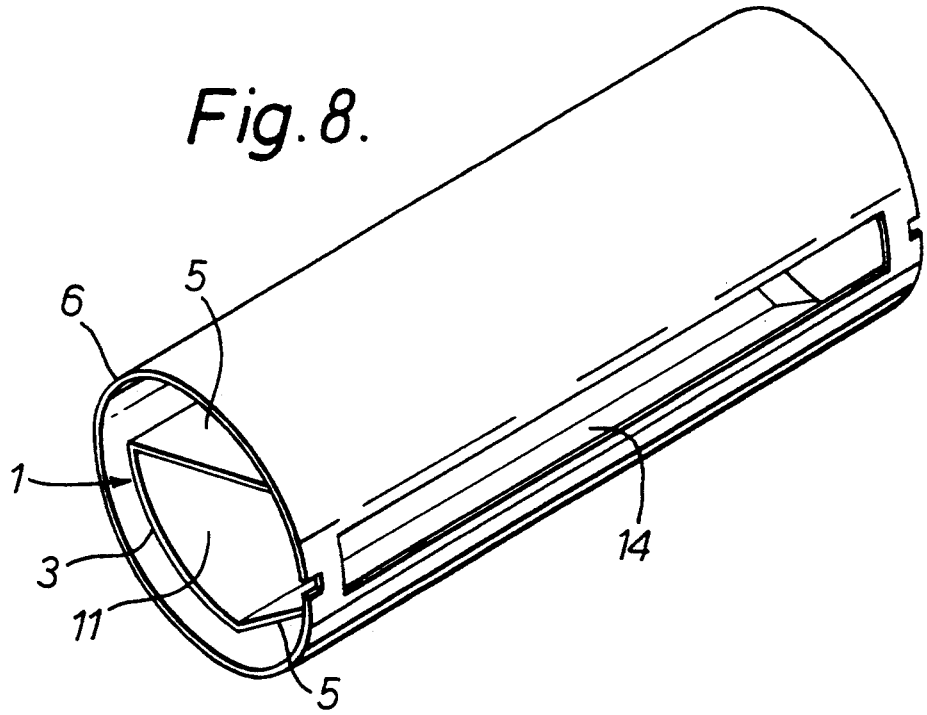
FIG. 8 is a detailed view of the inner tube of the cartridge of FIG. 7 showing the device incorporated therein.
Figure 9:
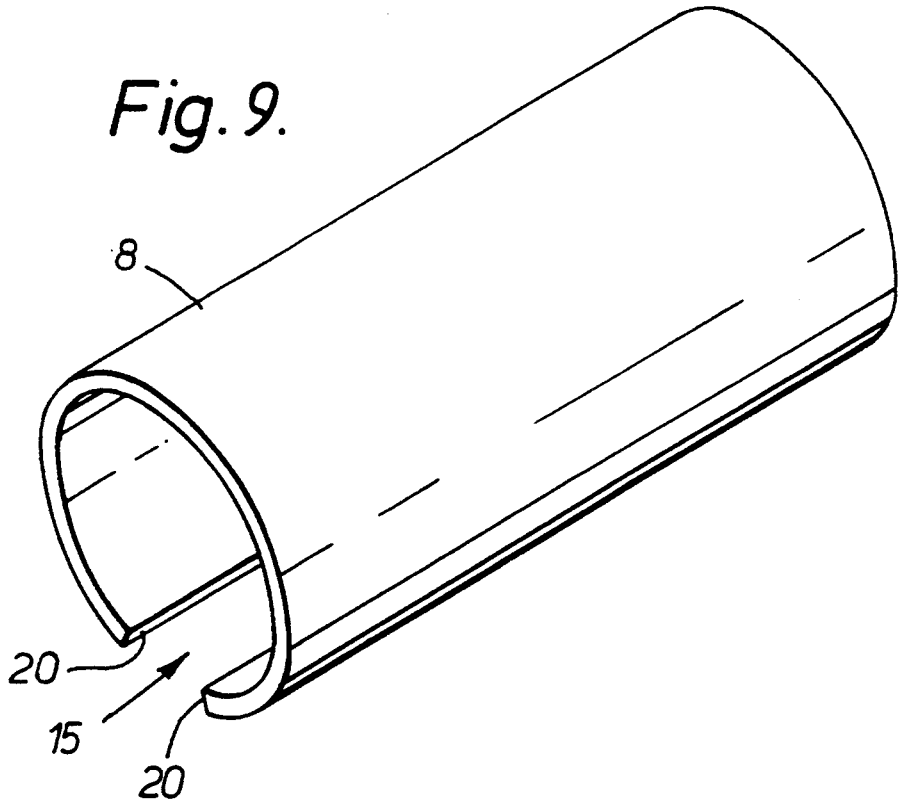
FIG. 9 is a detailed view of part of the outer tube of the cartridge of FIG. 7.

The inner tube 6 is shown in more detail in FIG. 8 from which it can be seen that the port 14 has a generally oblong shape the length of which is slightly less than the length of the inner tube 6. The device 1 is also illustrated within the inner tube 6. A part of the outer tube 8 is illustrated in FIG. 5 which shows a curved section of the tube cut away along its whole length leaving a gap 15 defined between longitudinal edges 20. The part is mounted on a plastic flange 22 shown in FIG. 6 which is oblong in shape and is formed with an oblong aperture through its central portion. This central aperture defines the port 16 for the outer tube 8 when the part is mounted on the flange 22.

Figure 10:
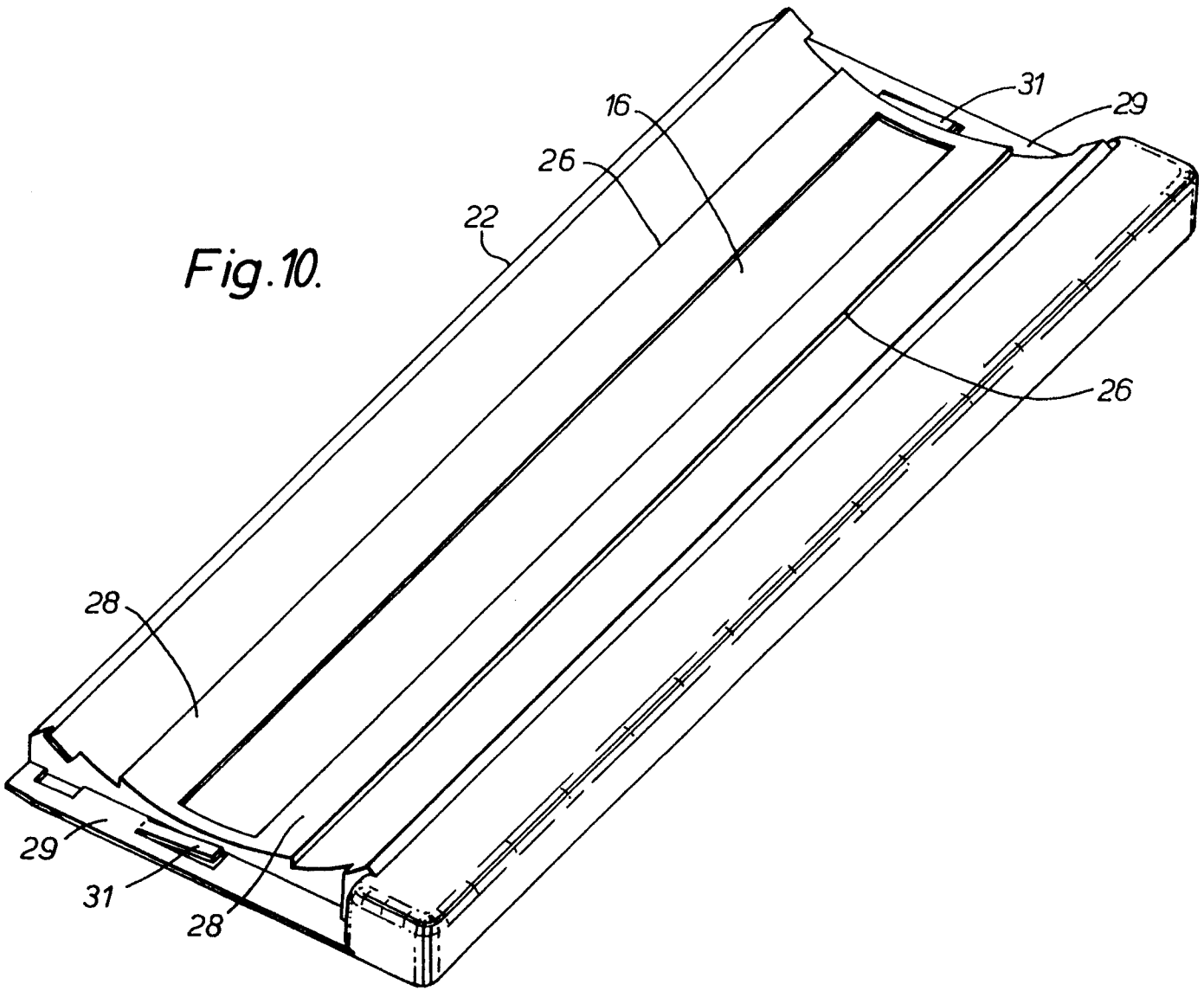
FIG. 10 is a more detailed view of the mounting flange of the cartridge shown in FIG. 6.
Figure 11:
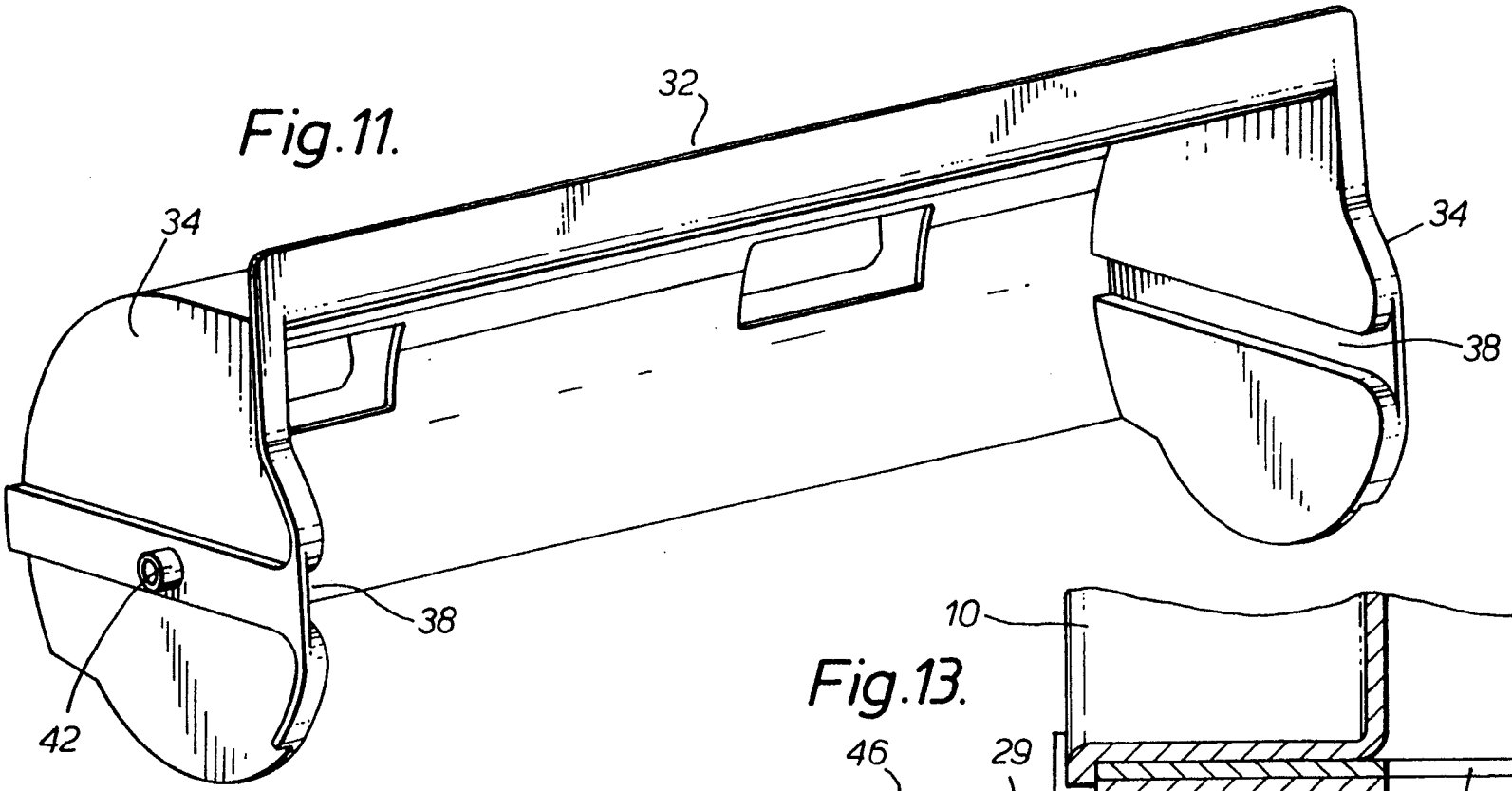
FIG. 11 is an illustration of one embodiment of a cartridge cover.

As shown in FIG. 10, and comparing with FIG. 7, the top of the flange 22 has shaped surfaces for cooperation with the outer tube 8 so that the straight longitudinal edges 20 of the outer tube 8 engage with longitudinal edges 26 on a pair of flange portions 28. The flange portions 28 have a wedge shaped cross-section which functions in the same way as extensions on the edges 20 of the outer tube 8, partly bridging the gap 15, and extending the curved contour of the inner surface of the outer tube 8 up to the port 16. Formed at each end of the flange are a pair of flat extension portions 29 which serve as locating means for the flange in a cover 32 (see FIG. 7). Each of the portions 29 is provided with a cut out resilient plastic catch 31. The function of the catches 31 is to engage with projections 33, extending from the rim of the end caps 10, 12, to prevent rotation of the end caps. Each of the end caps 10, 12 is in a snapped engagement with the inner tubular member 6 therefore movement of the inner tubular member 6 relative to the outer tubular member is also prevented maintaining the ports of the tubular members in a closed position during transit. The flanges 22 are also each provided with a foam seal 30 beneath the wedge shaped portions 28 (see FIG. 13).

During the assembly process the device I is first placed within the inner tube 6, the inner tube 6 then being inserted into the outer tube 8 and the outer tube 8 snapped or slid into place on the shoulders of the wedge shaped portions 28 of flange 22. The wedge shaped portions 28 provide an important function in that their narrowing to sharp edges to form the longitudinal sides of port 16 helps to keep the port 16 relatively clean of toner. The inner tube 6 is then filled with toner from a filling hole 24 which is then closed with a bung. In order to insert the cartridge unit into position over the sump 13 it is fitted into a cartridge cover 32 (see FIGS.

Figure 12:
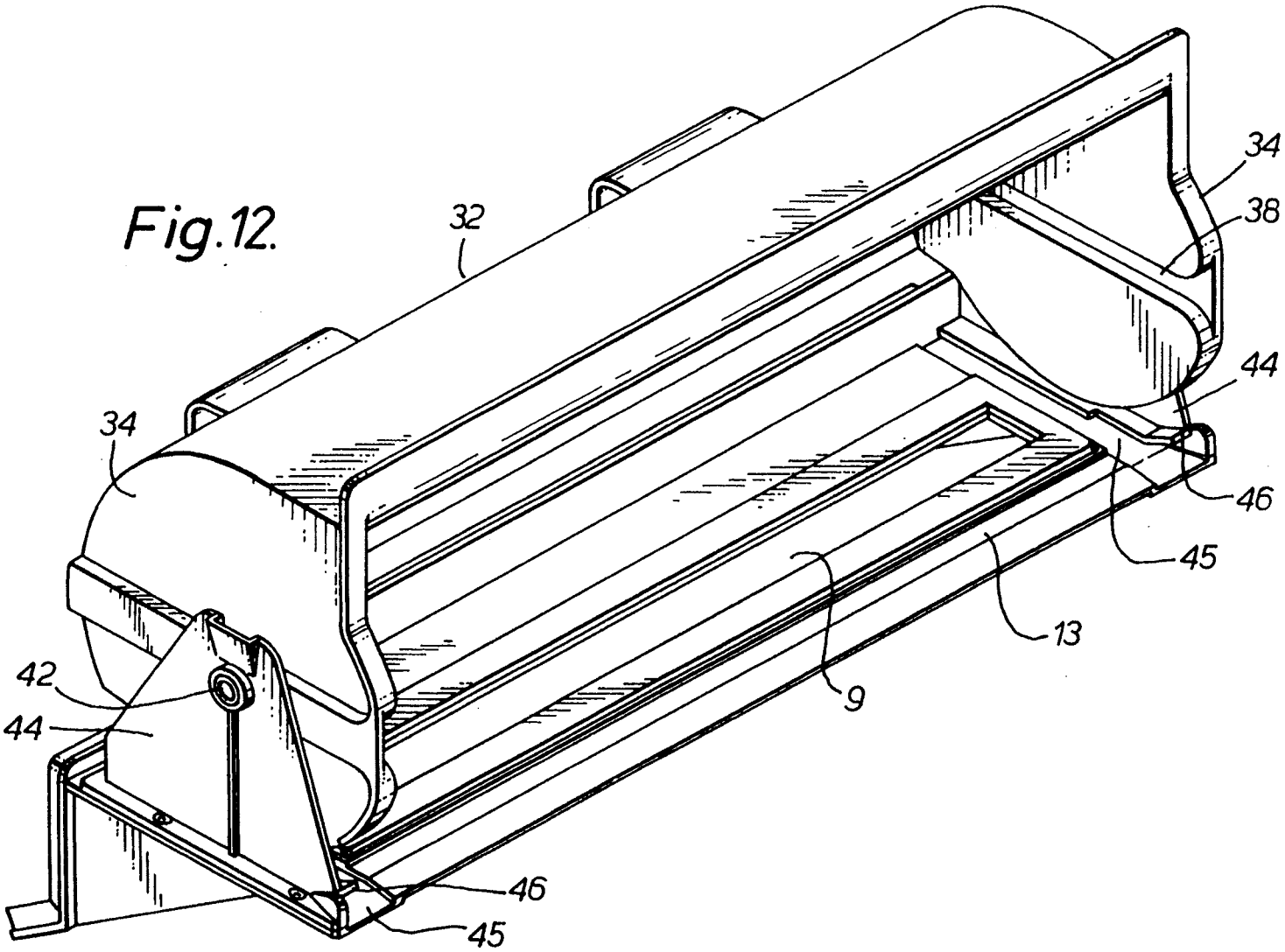
FIG. 12 is an illustration of the cartridge cover of FIG. 6 mounted between brackets above the inlet port of a toner sump.

11 and 12). The cover 32 has two end walls 34 each of which is provided on its inner surface with a respective channel 38. The channels 38 are provided for receiving the protrusions 39 formed on the end caps 10, 12. On the outer surface of each end wall 34 is provided a respective lug 42 (only one of which is shown) for use in pivotally mounting the cover 32 between mounting brackets 44 (see FIG. 12 ) disposed at opposite ends of the toner sump 13. Two guide channels 45 are provided beneath brackets 46 located at the bottom of the inside walls of the mounting brackets 44, the channels 45 being provided for receiving the extension portions 29 of the flange 22 to locate and retain the flange 22, and hence retain the outer tube 8, over the sump port 9. In order to mount the cartridge into the cover 32 it is necessary to move the cartridge towards the cover 32, for example as positioned in FIG. 8, so that the protrusions 39 on the end caps slide into the channels 38 on the inside walls of the cover 32 while the extensions 29 of the flange 22 are slid into the channels 45 defined beneath the brackets 46. An outer part of the catches 31 engage the underside of the brackets 46 forcing the catches downwards thereby releasing the projections 33. Clockwise rotation of the cover 32 about its pivotal axis can therefore cause rotation of the end caps and thereby rotation of the inner tubular member 6 until the port 14 is brought into alignment with the port 16 which is itself already in place over the port 9 of the sump 13. The whole of the cartridge unit is then covered by the cover 32.

In practice it is convenient to arrange the relative positions of the ports 14, 16 during transit to be at 90° to one another so that a 90° clockwise rotation of the cover 32 is sufficient to rotate the inner tubular member 6 to a position to define the exit aperture of the cartridge which is positioned over the port 9. When all of the toner in the cartridge is dispensed then anti-clockwise rotation of the cover 32 about its pivot axis will close the ports. The cartridge can now be easily removed from the cover 32 but is usually retained until the toner level in the toner sump within the dispense housing falls below a threshold level. A toner sensor in the dispense housing detects the level of toner and provides an indication as to when a further full cartridge should be loaded into the cartridge cover 32. The dispense housing is provided with two stirrer shafts with four paddles on each shaft to assist toner flow within the dispense housing.

Figure 13:
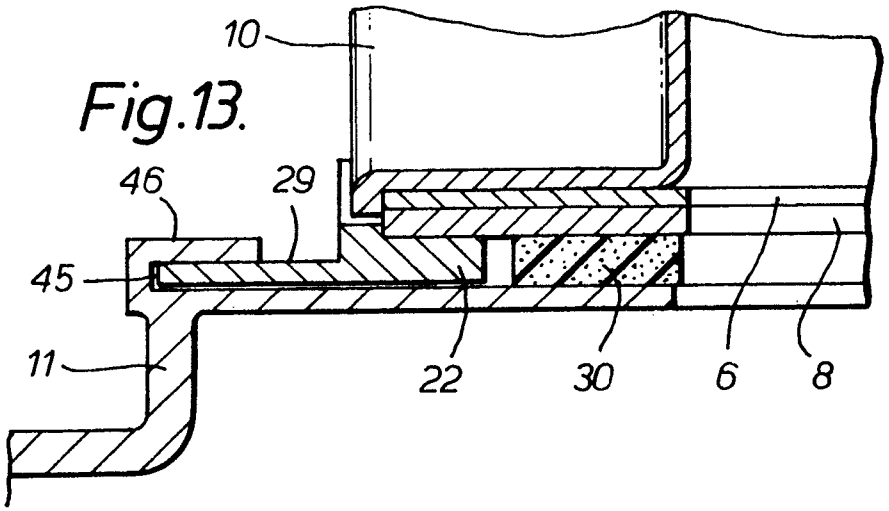
FIG. 13 is a part cross-section taken along the line Z—Z in FIG. 7.

FIG. 13 shows a part section Z—Z of one end of the arrangement in FIG. 3 but with the ports aligned. It can be seen how the end cap 10 is in frictional engagement with the rim, and with part of the internal surface, of the inner tube 6 so that rotation of the end cap 10 relative to the outer tube 8 causes identical relative rotation of the inner tube 6. The flange of the toner sump 11 is formed at the sides with a guide to define the channels 45 for the locating extensions 29 of the cartridge flange 22.

In alternative embodiments the cover 32 can be dispensed with, the cartridge being placed directly with its flange over the sump port and the inner tube 6 being rotated by means of a lever (or other means) until the inner tube port 6 lines up with the outer tube port and allows the toner to drop into the developer housing through the port in the sump flange. Reverse rotation will close the ports and allow removal of the cartridge unit when required.

While the invention has been described above in connection with preferred embodiments it is to be understood that it is not intended to limit the invention to those embodiments. On the contrary, it is intended to cover all alternatives, modifications and equivalents as may be included within the scope of the invention as defined by the appended claims. For example, the shape of the device I within the housing of the cartridge may take many different forms provided it is adapted, either inherently by its structure as a resilient or "memory type" material or by external biasing means, to alter its shape within the housing to assist in the dispensing of the material.

It will be appreciated that the embodiments of the invention provide a dispensing cartridge which has by means of the insert device a facility for minimizing the toner left behind in the cartridge.

I claim:

1. A dispensing cartridge adapted to discharge material therefrom to a receiving member during a dispensing operation comprising:

a substantially rigid outer member defining a chamber and an outer port therein, a substantially rigid inner member defining a chamber storing the material and an inner port therein, said inner member being located within the chamber of said outer member with the inner port thereof being aligned with the outer port of said outer member during the dispensing operation, said inner member deflecting to conform to said outer member when substantially filled with material and deflecting away from said outer member during the dispensing operation to facilitate the dispensing of material from the chamber of said inner member, through the inner and outer port, and to the receiving member.

2. A dispensing cartridge as claimed in claim 1, wherein said inner member comprises a first portion fixed relative to said outer member, and a second portion movable relative to said outer member whereby the chamber of said inner member decreases during the dispensing operation.

3. A dispensing cartridge as claimed in claim 2, wherein said inner member includes a flexible bladder disposed in the chamber of said outer member.

4. A dispensing cartridge as claimed in claim 1, wherein said inner member comprises a substantially V-shaped section, the apex of said V-shaped section being adjacent to said outer member with the remainder of said V-shaped section forming flaps adapted to move toward said outer member as material is added thereto and said outer member as material is dispensed therefrom.

5. A dispensing cartridge as claimed in claim 1, wherein said inner member comprises an extendible member expanding as material is added thereto, increasing the volume of the chamber defined by said inner member and contracting as material is dispensed therefrom by reducing the volume of the inner chamber.

6. A dispensing cartridge as claimed in claim 1, wherein said inner member is made from a resilient material.

7. A dispensing cartridge as claimed in claim 1, wherein said inner member is made of a deformable material adapted to return to its original configuration after being deformed.

8. A dispensing cartridge adapted to discharge material therefrom to a receiving member during a dispensing operation comprising:

an outer member defining a chamber and an outer port therein, an inner member defining a chamber storing the material and an inner port therein, said inner member being located within the chamber of said outer member with the inner port thereof being aligned with the outer port of said outer member during the dispensing operation, said inner member being adapted to change shape during the dispensing operation to facilitate the dispensing of material from the chamber of said inner member, through the inner and outer port, and to the receiving member, wherein said inner member comprises an elongated structure for fitting within said outer member, said elongated member including a substantially U-shaped section, having at least a portion of the curved portion of the U-shaped section fixed to said outer member, and a resilient portion located on each side of the curved portion being adapted to move towards said outer member as material is added thereto and to move away from said outer member as material is dispensed therefrom.

9. A dispensing cartridge adapted to discharge material therefrom to a receiving member during a dispensing operation comprising:

an outer member defining a chamber and an outer port therein, an inner member defining a chamber storing the material and an inner port therein, said inner member being located within the chamber of said outer member with the inner port thereof being aligned with the outer port of said outer member during the dispensing operation, said inner member being adapted to change shape during the dispensing operation to facilitate the dispensing of material from the chamber of said inner member, through the inner and outer port, and to the receiving member, wherein said inner member comprises an elongated structure including a curved central portion fixed to said outer member, and a side flap attached to one side of said curved portion, said flap being designed to bend and hug said outer member as material is added thereto and move and straighten as material is dispensed therefrom.

10. A dispensing cartridge adapted to discharge material therefrom to a receiving member during a dispensing operation comprising:

an outer member defining a chamber and an outer port therein, an inner member defining a chamber storing the material and an inner port therein, said inner member being located within the chamber of said outer member with the inner port thereof being aligned with the outer port of said outer member during the dispensing operation, said inner member being adapted to change shape during the dispensing operation to facilitate the dispensing of material from the chamber of said inner member, through the inner and outer port, and to the receiving member, wherein said inner member comprises a substantially V-shaped section, the apex of said V-shaped section being adjacent to said outer member with the remainder of said V-shaped section forming flaps adapted to move toward said outer member as material is added thereto and said outer member as material is dispensed therefrom, wherein the flaps of said V-shaped section include free ends substantially in line with the edge of the ports after dispensing material therefrom.

* * * * *